US008528164B2

(12) United States Patent
Conrad

(10) Patent No.: US 8,528,164 B2
(45) Date of Patent: Sep. 10, 2013

(54) CYCLONE CHAMBER FOR A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 225 days.

(21) Appl. No.: 13/040,768

(22) Filed: Mar. 4, 2011

(65) Prior Publication Data

US 2012/0222256 A1 Sep. 6, 2012

(51) Int. Cl.
*A47L 9/16* (2006.01)

(52) U.S. Cl.
USPC ..... 15/353; 15/347; 55/337; 55/428; 55/DIG. 3

(58) Field of Classification Search
USPC ..... 15/347, 353, 327.6, 327.7; 55/337, 55/428, 429, DIG. 3, 467, 471
See application file for complete search history.

(56) References Cited

U.S. PATENT DOCUMENTS

| | | | | |
|---|---|---|---|---|
| 6,902,596 | B2 | 6/2005 | Conrad | |
| 7,152,275 | B2 * | 12/2006 | Hitzelberger et al. | 15/352 |
| 7,186,283 | B2 * | 3/2007 | Vuijk | 55/343 |
| 7,222,392 | B2 * | 5/2007 | McCormick et al. | 15/353 |
| 7,922,794 | B2 * | 4/2011 | Morphey | 95/271 |
| 2005/0160554 | A1 * | 7/2005 | Ueyama et al. | 15/353 |
| 2009/0133370 | A1 * | 5/2009 | Yoo et al. | 55/429 |
| 2009/0205160 | A1 | 8/2009 | Conrad | |
| 2009/0205161 | A1 | 8/2009 | Conrad | |
| 2010/0175217 | A1 | 7/2010 | Conrad | |
| 2010/0212104 | A1 | 8/2010 | Conrad | |
| 2010/0242210 | A1 | 9/2010 | Conrad | |
| 2010/0243158 | A1 | 9/2010 | Conrad | |
| 2010/0299865 | A1 | 12/2010 | Conrad | |
| 2010/0299866 | A1 | 12/2010 | Conrad | |
| 2011/0146024 | A1 | 6/2011 | Conrad | |

FOREIGN PATENT DOCUMENTS

| | | |
|---|---|---|
| CA | 2659212 | 9/2010 |
| WO | 2010102396 | 9/2010 |

* cited by examiner

*Primary Examiner* — Mark Spisich
*Assistant Examiner* — Andrew A Horton
(74) *Attorney, Agent, or Firm* — Philip C. Mendes da Costa; Bereskin & Parr LLP/S.E.N.C.R.L., s.r.l.

(57) ABSTRACT

A surface cleaning apparatus may comprise an air flow path extending from a dirty air inlet to a clean air outlet and a suction motor. The surface cleaning apparatus may comprise a cyclone chamber provided in the air flow path. The cyclone chamber may comprise a cyclone chamber first end and a cyclone chamber second opposed end, a cyclone air inlet, a cyclone air outlet provided at the cyclone chamber second opposed end and a cyclone chamber wall. An air exit conduit may be exterior to the cyclone chamber and may extend from the cyclone air outlet. At least one reinforcing rib may be positioned in abutting relationship with the air exit conduit and the cyclone chamber second opposed end.

18 Claims, 12 Drawing Sheets

CYCLONE CHAMBER FOR A SURFACE CLEANING APPARATUS

FIELD

The disclosure relates to surface cleaning apparatuses, such as vacuum cleaners.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one broad aspect, a cyclone bin assembly comprises a cyclone chamber and a dirt collection chamber. The cyclone air outlet is in communication with an exit duct conduit (which may be a down duct depending upon the orientation of the duct conduit) extending away from the cyclone air outlet and preferably through (e.g., linearly through) a dirt collection chamber facing the end of the cyclone chamber with the air outlet. The down duct may extend from the floor of the cyclone chamber to the floor of the dirt collection chamber. Reinforcing ribs extend between the down duct and the floor of the cyclone chamber. The ribs may help reduce vibrations in the down duct, including, for example, vibrations induced by air flowing through the down duct. Optionally, the down duct and/or the support ribs can be removable.

An advantage of this configuration may be that vibration of the down duct may be reduced. Reducing the vibration of the down duct may help reduce the overall amount of noise generated by the surface cleaning apparatus and/or improve the separation efficiency of the cyclone chamber and the dirt collection chamber.

The dirt collection chamber may extend from a dirt inlet towards a dirt collection area. For example, the dirt inlet may be in an upper portion of the dirt collection chamber and the dirt collection area may be the floor of the dirt collection chamber. The dirt collection chamber comprises a sidewall (preferably an outer sidewall) that extends longitudinally between opposing first and second ends of the dirt collection chamber. Air circulating within the dirt collection chamber may flow along the sidewall. For example, air may exit the dirt outlet of the cyclone chamber and rotate around the dirt collection chamber and travel towards the dirt collection area. The air will at some point travel in the reverse direction towards the dirt inlet and re-enter the cyclone chamber. The dirt collection chamber may be configured such that the cross sectional area of the dirt collection chamber in a plane transverse to its length changes at least once along the length of the dirt collection chamber. In some embodiments, the cross-sectional area at the first end of the dirt collection chamber is different than the cross-sectional area at the second end of the dirt collection chamber.

An advantage of this configuration may be that changes in the cross-sectional area may be used to enhance the separation efficiency of the cyclone chamber and associated dirt collection chamber. By varying the transverse cross sectional area of the dirt collection chamber, the flow dynamics of the air in the dirt collection chamber may be varied and the amount of dirt that is dis-entrained from the air may be decreased, or the amount of dirt that is re-entrained may be reduced. For example, if the cross sectional area of the portion of the dirt collection chamber distal to the dirt inlet (e.g., the lower portion) is less than the opposed portion (e.g. upper portion) adjacent the dirt inlet, then the air will slow down as it enters the upper portion. As the velocity decreases, the amount of dirt that may be re-entrained in the return airflow may decrease. If the cross sectional area of the portion of the dirt collection chamber distal to the dirt inlet (e.g., the lower portion) is greater than the opposed portion (e.g. upper portion) adjacent the dirt inlet, then the air will slow down as it enters the lower portion allowing more dirt to be dis-entrained.

The cyclone chamber and dirt collection chamber assembly may be used in any surface cleaning apparatus. The surface cleaning apparatus comprises an air flow path extending from a dirty air inlet to a clean air outlet. A suction motor is provided in the air flow path, and a cyclone bin assembly is provided in the air flow path, preferably upstream from the suction motor. The cyclone bin assembly may comprise the cyclone chamber and a dirt collection chamber. Dirty air from the dirty air inlet can circulate within the cyclone chamber and may exit the cyclone chamber to circulate within the dirt collection chamber.

The cyclone bin assembly may also comprise a fine particle separator, to help separate relatively fine dirt particles from the dirty air. The fine particle separator comprises a flow chamber through which the dirty air can circulate. Dirty air, carrying entrained fine dirt particles can flow from the cyclone chamber into the fine particle separator. Air exiting the fine particle separator can re-enter the cyclone chamber, and travel to the suction motor via a cyclone air outlet.

The fine particle separator is configured so that air circulating in the flow chamber can travel at a relatively high velocity, and may travel faster than the air circulating within the cyclone chamber. To help increase the air flow velocity the cross-sectional area of the flow chamber, in the flow direction, can be varied, and preferably is reduced. Accelerating the dirty air to a relatively higher velocity may help dis-entrain fine dirt particles.

The air outlet of the fine particle separator flow chamber may be configured to disrupt the flow of air exiting the flow chamber. Disrupting the flow of air, for example by introducing eddy currents and/or turbulence and/or directing the air away from the cyclone dirt outlet, may help separate fine dirt particles from the air stream. Separated dirt particles can fall into the dirt collection chamber.

An advantage of this configuration may be a more efficient separation of fine dirt particles from the dirty air stream. Separating fine dirt particles from the dirty air stream in the fine particle separator may help prevent the fine dirt particles from continuing downstream from the cyclone bin assembly, and, for example, fouling the suction motor and/or a pre-motor filter.

In accordance with this aspect, a surface cleaning apparatus may comprise an air flow path extending from a dirty air inlet to a clean air outlet and a suction motor. The surface cleaning apparatus may comprise a cyclone chamber provided in the air flow path. The cyclone chamber may comprise a cyclone chamber first end and a cyclone chamber second opposed end, a cyclone air inlet, a cyclone air outlet provided at the cyclone chamber second opposed end and a cyclone chamber wall. An air exit conduit may be exterior to the cyclone chamber and may extend from the cyclone air outlet. At least one reinforcing rib may be positioned in abutting relationship with the air exit conduit and the cyclone chamber second opposed end.

The reinforcing rib may be connected to the air exit conduit.

The reinforcing rib may be connected to the cyclone chamber second opposed end.

The air exit conduit may extend through a dirt collection chamber that may be positioned exterior to the cyclone chamber.

The air exit conduit may be removably mounted to the cyclone chamber.

The cyclone chamber may comprise a vortex finder and the vortex finder remains in position when the air exit conduit is removed.

The cyclone air inlet may be located adjacent the cyclone chamber second opposed end.

The cyclone chamber may comprise a cyclone dirt outlet located adjacent the cyclone chamber first end. The surface cleaning apparatus may comprise a dirt collection chamber in communication with the cyclone dirt outlet.

The dirt collection chamber may extend at least part way around the cyclone chamber. The dirt collection chamber may have a dirt collection chamber first end and a dirt collection chamber second opposed end that may be spaced from and may face the cyclone chamber second opposed end. The air exit conduit may extend between the cyclone chamber second opposed end and the dirt collection chamber second opposed end.

The surface cleaning apparatus may comprise a cyclone bin assembly that is removably mounted to the surface cleaning apparatus, the cyclone bin assembly comprising the cyclone chamber and a dirt collection chamber.

The air exit conduit may extend through the dirt collection chamber.

The cyclone air outlet may be provided in the cyclone chamber second opposed end. The dirt collection chamber may have a dirt collection chamber end that is spaced from and faces the cyclone chamber second opposed end. The air exit conduit may extend between the cyclone chamber second opposed end and the dirt collection chamber end.

The dirt collection chamber end may be openable.

The dirt collection chamber end may have an air exit port in communication with the air exit conduit and the air exit conduit remains in position when the dirt collection chamber end is opened.

The air exit conduit may be removably mounted to the cyclone chamber.

The cyclone chamber may comprise a vortex finder and the vortex finder may remain in position when the air exit conduit is removed.

The cyclone air inlet may be located adjacent the cyclone chamber second opposed end.

The cyclone chamber may comprise a cyclone dirt outlet located adjacent the cyclone chamber first end. The surface cleaning apparatus may comprise a dirt collection chamber in communication with the cyclone dirt outlet.

DRAWINGS

Reference is made in the detailed description to the accompanying drawings, in which.

Figure 2:
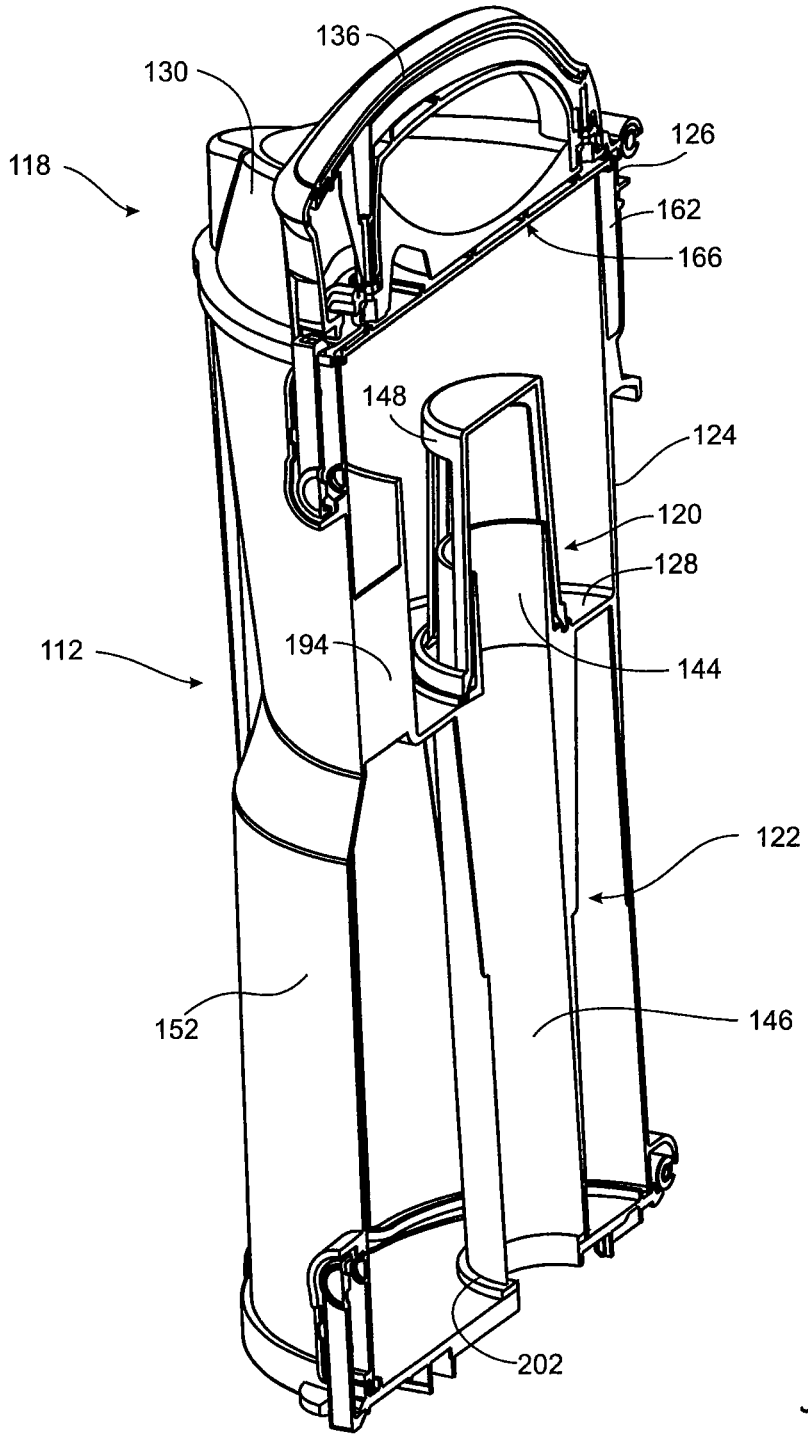
FIG. 2 is perspective cross sectional view of the cyclone bin assembly of the surface cleaning apparatus of FIG. 1, taken along line 2-2 in FIG. 1.
Figure 8:
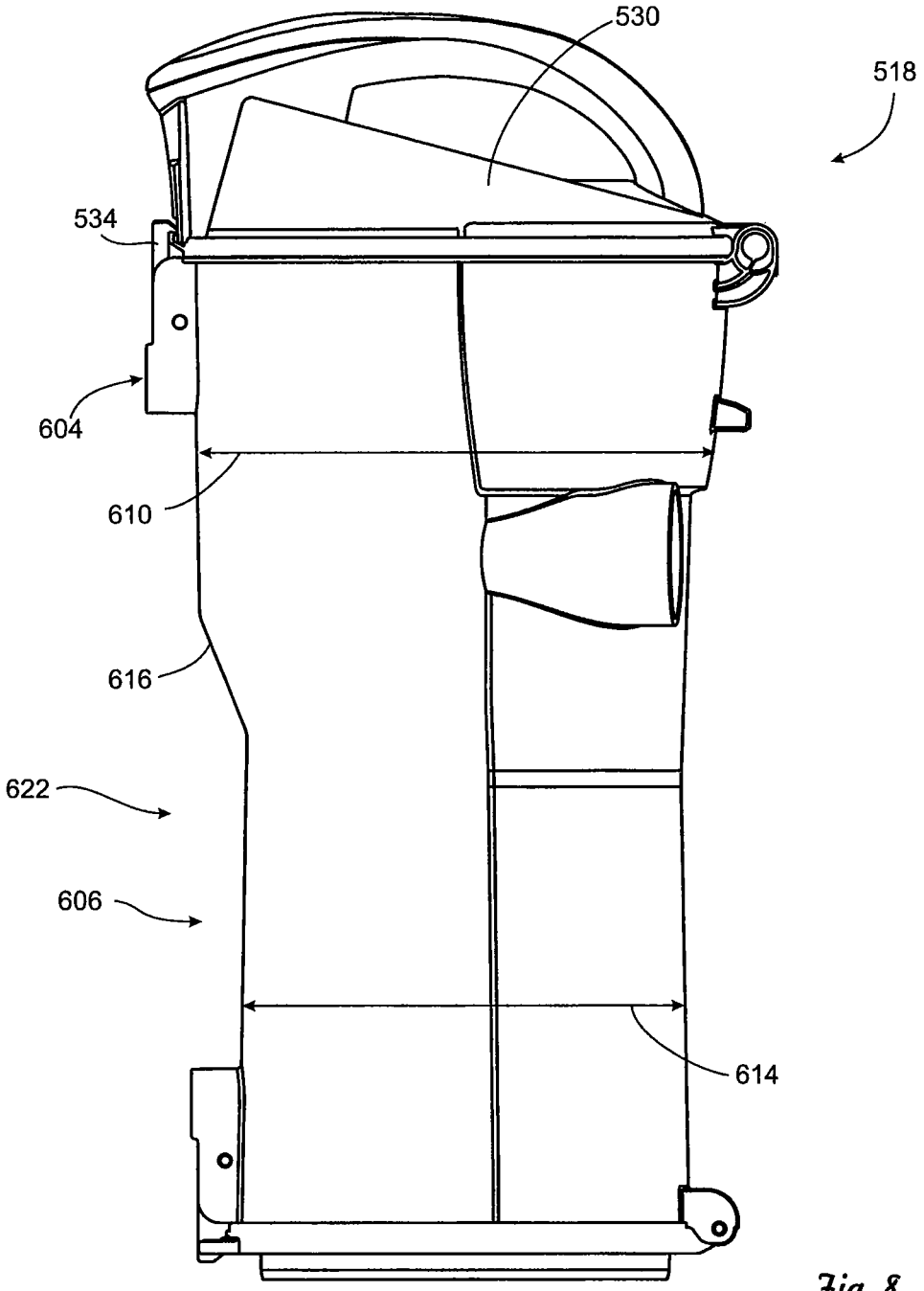
Figure 9:
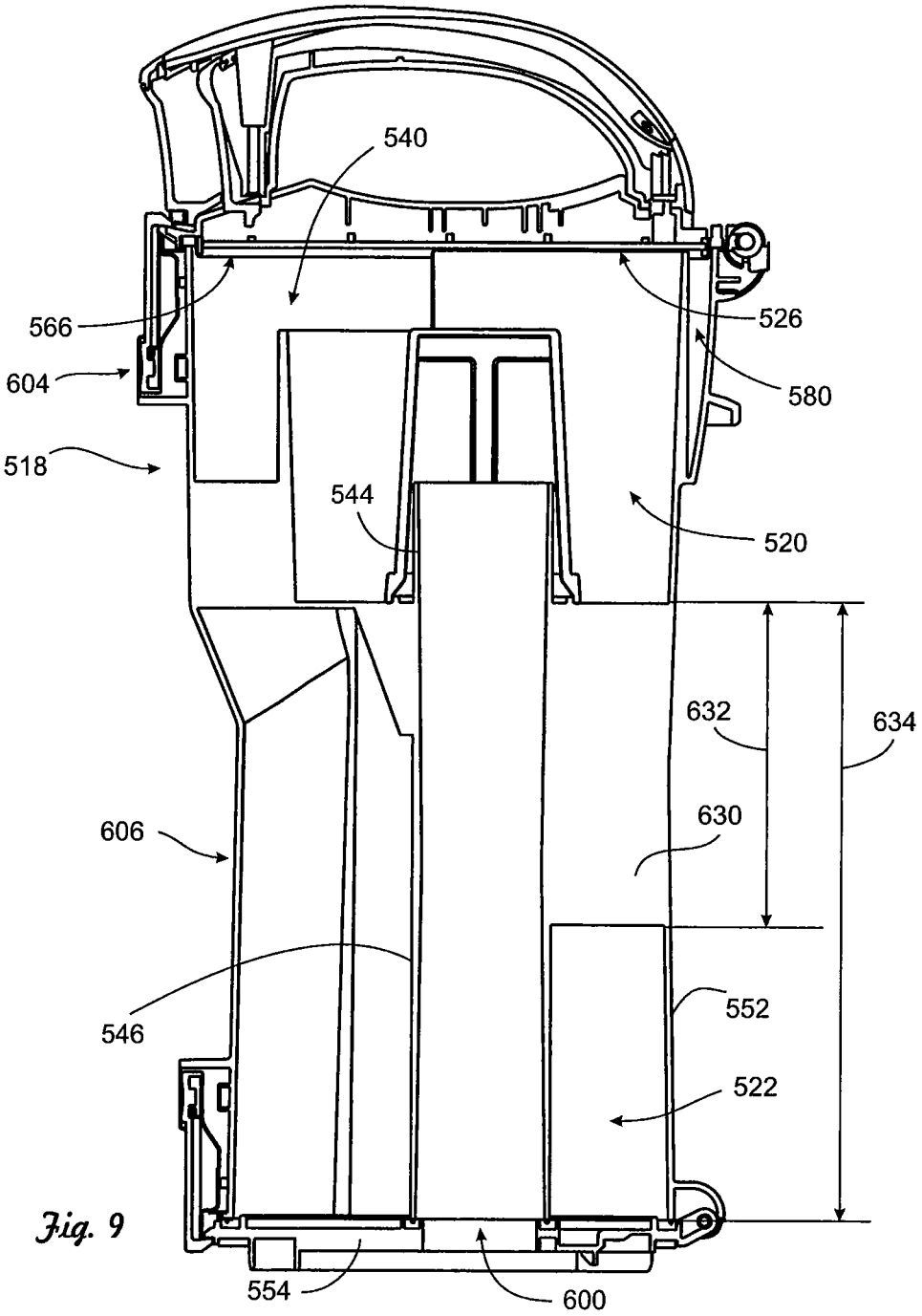
Figure 10:
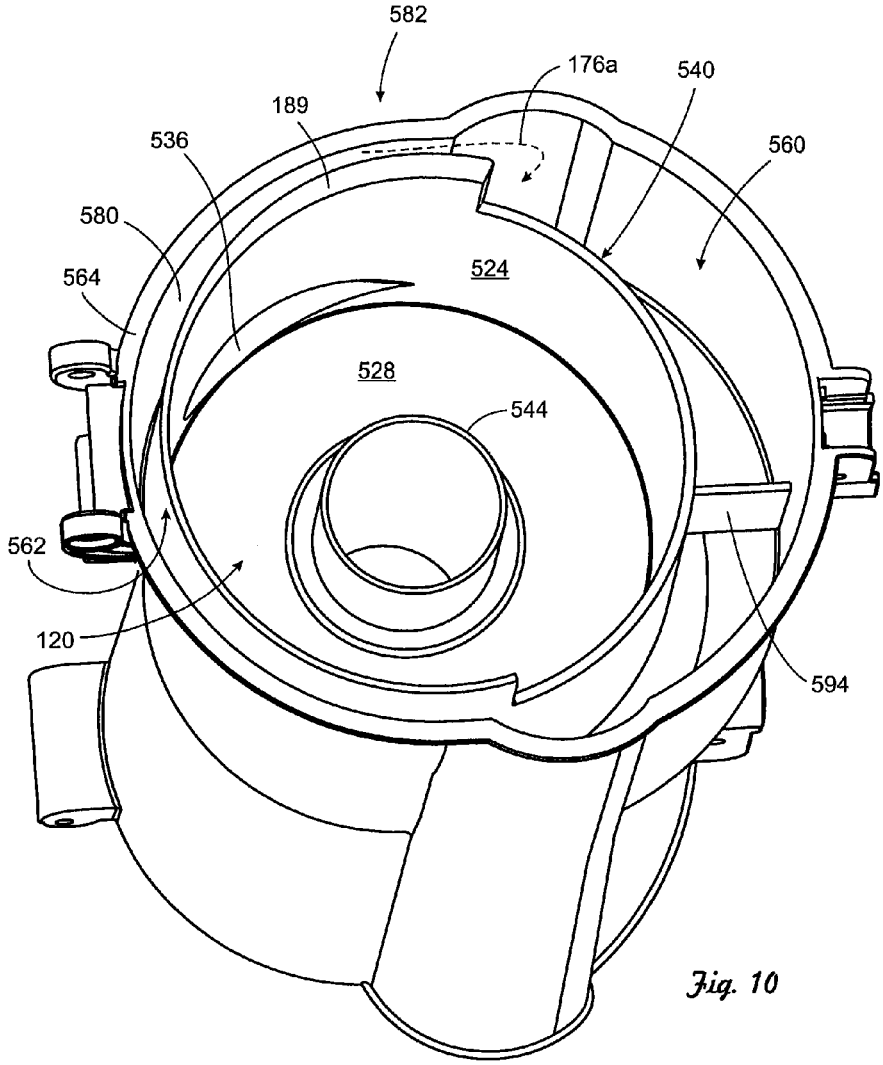
Figure 11:
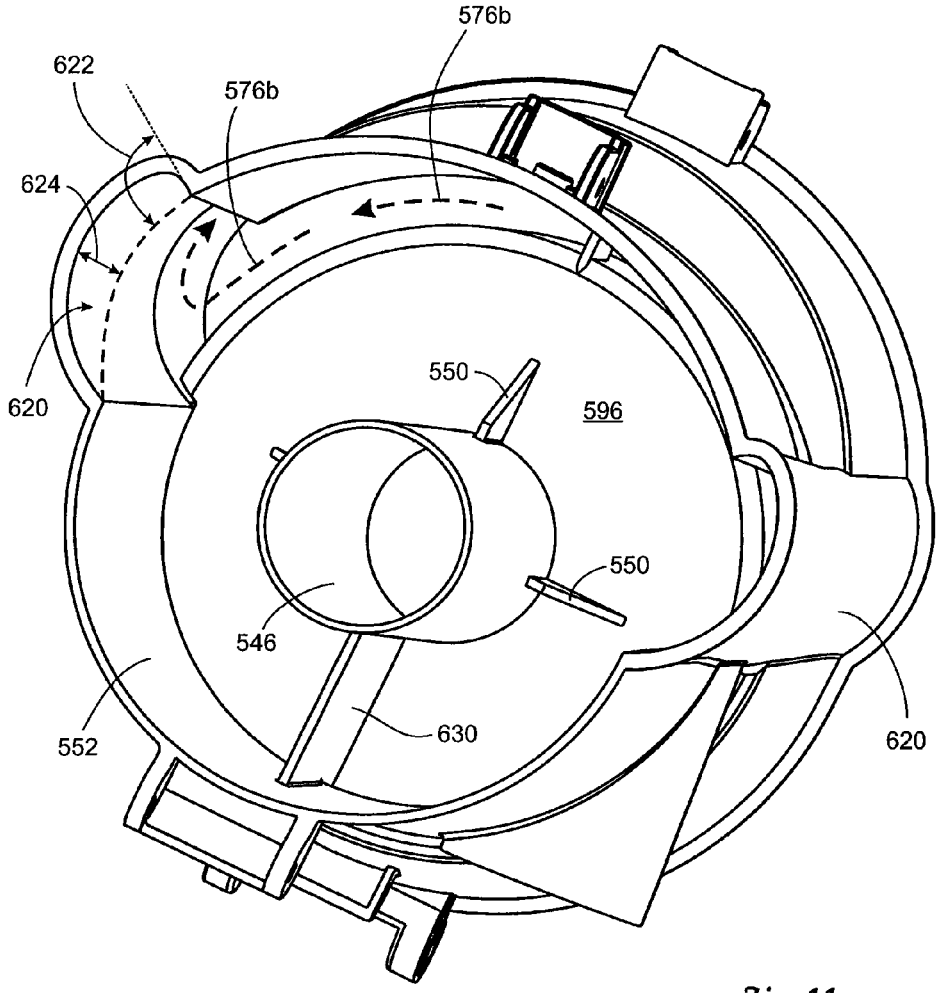
Figure 12A:
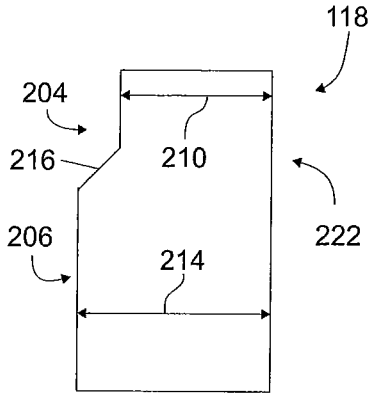
Figure 12B:
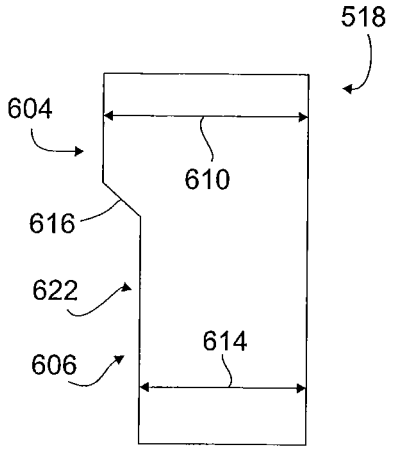
Figure 12C:
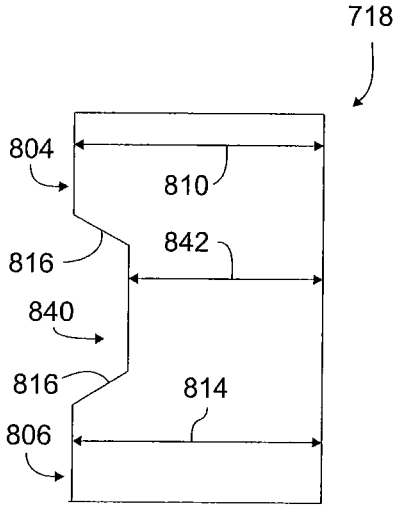
Figure 12D:
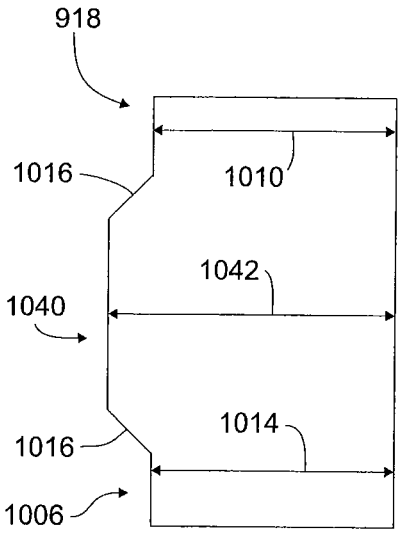

FIG. 7*a*-7*e* are alternate schematic representations of a fine particle separator;

FIG. 8 is a side view of an alternate embodiment of a cyclone bin assembly that is usable with a surface cleaning apparatus;

FIG. 9 is cross-sectional side view of the cyclone bin assembly of FIG. 8;

FIG. 10 is a top perspective view of the cyclone bin assembly of FIG. 8, with the lid removed;

FIG. 11 is a bottom perspective view of the cyclone bin assembly of FIG. 8, with the dirt chamber floor removed;

FIG. 12*a* is a schematic side view of the cyclone bin assembly of FIG. 2;

FIG. 12*b* is a schematic side view of the cyclone bin assembly of FIG. 8;

FIG. 12*c* is a schematic side view of an alternate embodiment of a cyclone bin assembly usable with a surface cleaning apparatus; and FIG. 12*d* is a schematic side view of an alternate embodiment of a cyclone bin assembly usable with a surface cleaning apparatus.

DETAILED DESCRIPTION

Figure 1:
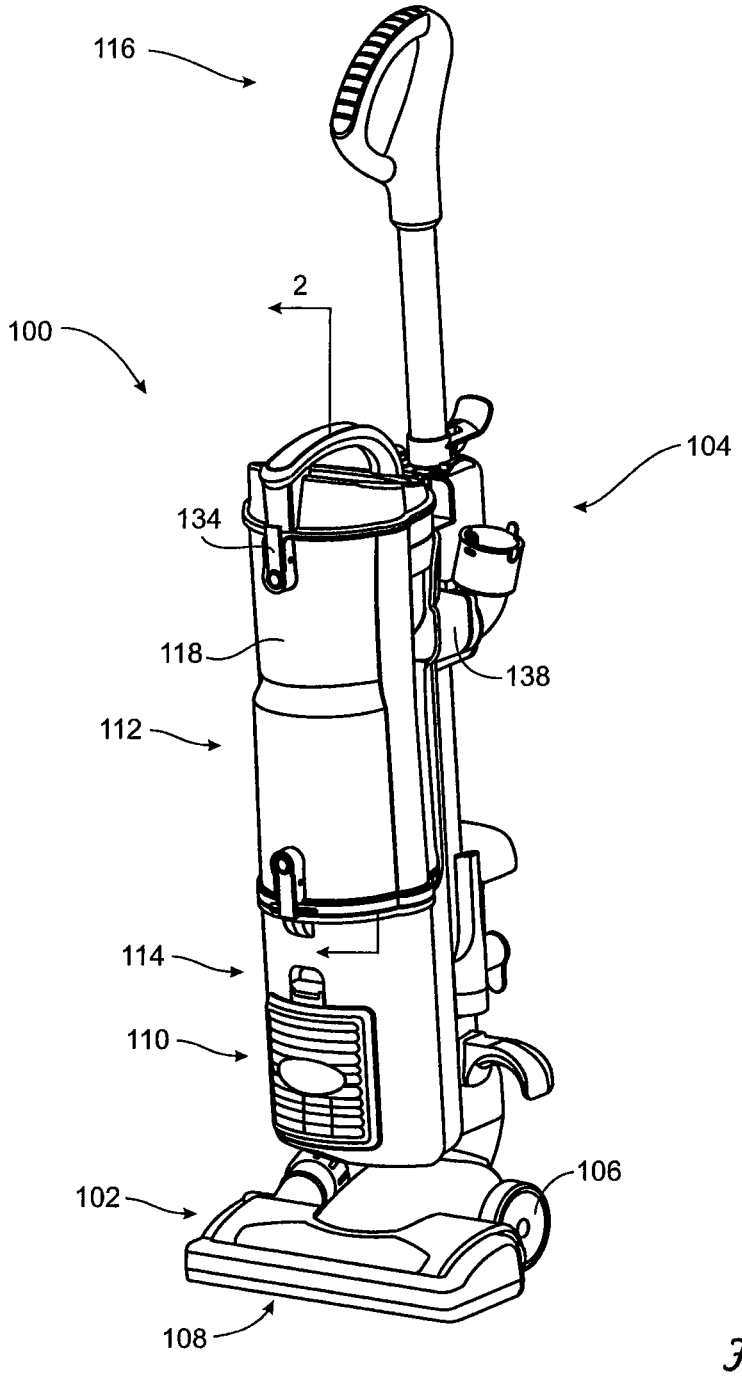
FIG. 1 is a perspective view of an embodiment of a surface cleaning apparatus.

Referring to FIG. 1, an embodiment of a surface cleaning apparatus 100 is shown. In the embodiment illustrated, the surface cleaning apparatus 100 is an upright surface cleaning apparatus. In alternate embodiments, the surface cleaning apparatus may be another suitable type of surface cleaning apparatus, including, for example, a hand vacuum, a canister vacuum cleaner, a stick vac, a wet-dry vacuum cleaner and a carpet extractor.

General Overview

Referring still to FIG. 1, the surface cleaning apparatus 100 includes a surface cleaning head 102 and an upper section 104. The surface cleaning head 102 includes a pair of rear wheels 106 and a pair of front wheels (not shown) for rolling across a surface and a dirty air inlet 108 provided at the front end. The upper section 104 is moveably connected to the surface cleaning head 102. The upper section 104 is moveable (e.g., pivotally mounted to the surface cleaning head 102) between a storage position and an in use position. An air flow passage extends from the dirty air inlet 108 to a clean air outlet 110 on the upper section 104.

A handle 116 is provided on the upper section 104 for manipulating the surface cleaning apparatus.

Referring to FIGS. 1 and 2, in the example illustrated, the upper section 104 comprises an air treatment housing 112 and a suction motor housing 114, which is preferably positioned below air treatment housing 112. The air treatment housing 112 houses an air treatment member, which is positioned in the air flow passage downstream from the dirty air inlet 108 to remove dirt particles and other debris from the air flowing through the air flow path. In the illustrated example, the air treatment member comprises a cyclone bin assembly 118. The suction motor housing 114 is configured to house a suction motor (not shown). The suction motor is in air flow communication with the air flow path, downstream from the cyclone bin assembly 118. The cyclone bin assembly 118 comprises a cyclone chamber 120 and a dirt collection chamber 122.

Cyclone Bin Assembly

As exemplified in FIGS. 2-6, the cyclone chamber 120 may be an inverted cyclone and may be oriented with the dirt inlet at an upper end thereof. In other configurations, it will be appreciated that cyclone chamber 120 may be in a different orientation and may be of a different configuration.

Figure 4:
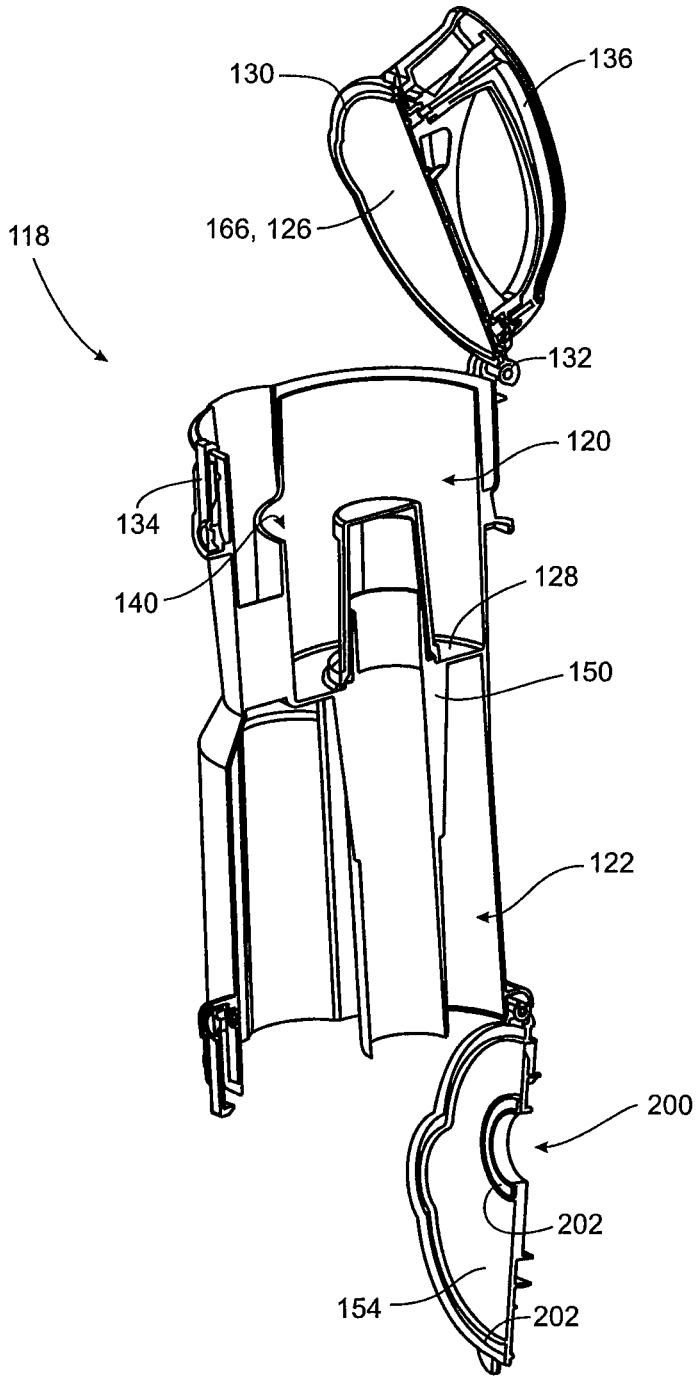
FIG. 4 is a perspective cross sectional view of the cyclone bin assembly as shown in FIG. 2, with its lid and dirt chamber floor open.
Figure 5:
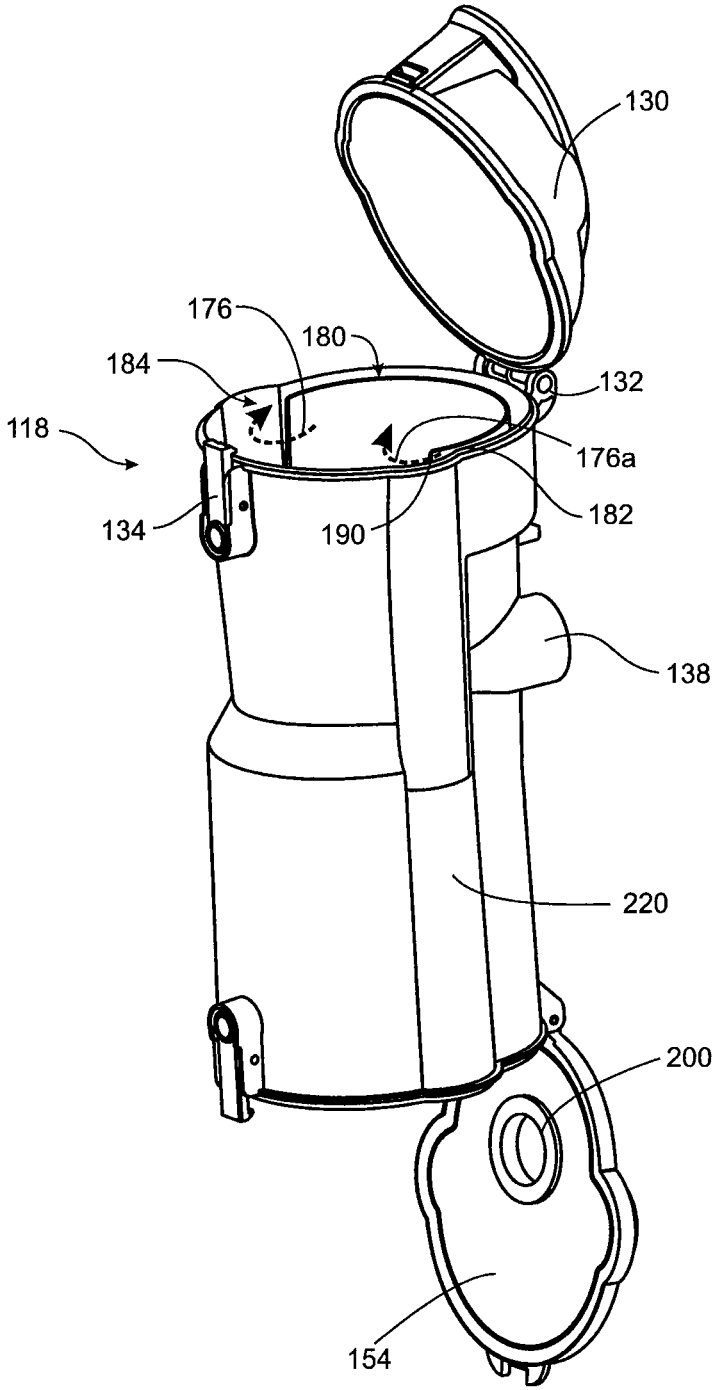
FIG. 5 is a perspective view of the cyclone bin assembly of from the surface cleaning apparatus of FIG. 1, with its lid and dirt chamber floor open.

Cyclone chamber 120 is bounded by a sidewall 124, a first end wall 126 and a second end wall, or floor, 128 that are configured to provide an inverted cyclone configuration. A lid 130 covers the top of the cyclone chamber 120, and an inner surface of the lid 130 comprises the first end wall 126 of the cyclone chamber 120. Preferably, the lid 130 is openable. Opening the lid 130 may allow a user to access the interior of the cyclone chamber 120, for example for cleaning. In the illustrated example, the lid 130 is pivotally connected to the cyclone bin assembly 118 by a hinge 132, and is movable between a closed configuration (FIG. 2) and an open configuration (FIGS. 4 and 5). The lid 130 can be held in the closed position by any means known in the art, such as a releasable latch 134. A handle 136 may be provided on the lid 130. The handle 136 can be used to manipulate the cyclone bin assembly 118 when it is detached from the upper section 104.

A tangential air inlet 138 may be provided in the sidewall 124 of the cyclone chamber 120 and is in fluid communication with the dirty air inlet 108. Air flowing into the cyclone chamber 120 via the air inlet 138 can circulate around the interior of the cyclone chamber 120 and dirt particles and other debris can become dis-entrained from the circulating air.

Dirt collection chamber 122 is in communication with cyclone chamber 120. Air with entrained dirt exits the cyclone chamber 120 via a cyclone dirt outlet 140 and enters the dirt collection chamber via a dirt collection chamber inlet. After circulating in the dirt collection chamber 122, air may re-enter the cyclone chamber 118 via the dirt collection chamber inlet and the cyclone dirt outlet 140. Preferably, the dirt collection chamber inlet and the cyclone dirt outlet 140 are the same element. For example, as exemplified, the cyclone dirt outlet 140 may be a slot formed between the sidewall 124 and the first end wall 126. The slot 140 may also function as a dirt inlet for the dirt collection chamber 122. Debris separated from the air flow in the cyclone chamber 120 can travel from the cyclone chamber 120, through the dirt outlet 140 to the dirt collection chamber 122. Preferably, the slot comprises a gap formed between the end of the sidewall 124 and end wall 126 that extends part way around the cyclone chamber 118 (e.g., up to 150°, preferably 30-150°, more preferably 60-120°).

As exemplified, the cyclone chamber 118 may be positioned within the dirt collection chamber 122 and the dirt collection chamber 122 may comprise an annular portion surrounding part or all of the cyclone chamber 118. Alternately, or in addition, the cyclone chamber 118 may be positioned such that a portion of the dirt collection chamber 122 is positioned opposed to and facing (e.g., below) the air exit end of the cyclone chamber 118. The annular portion may merge into, and be contiguous with, the lower portion of the dirt collection chamber 122.

Figure 3:
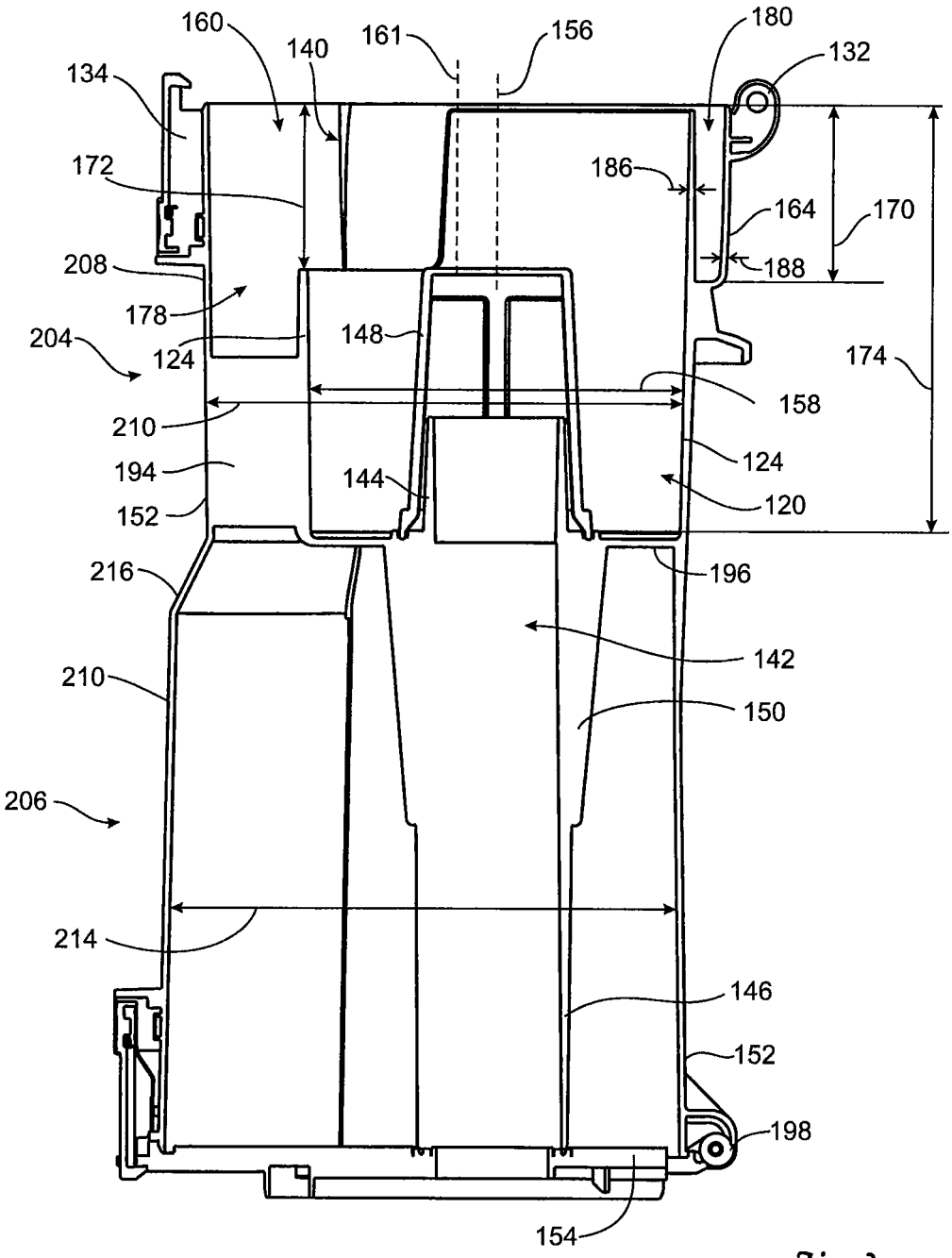
FIG. 3 is a side view of the cyclone bin assembly as shown in FIG. 2.

The cyclone chamber 120 extends along a longitudinal cyclone axis 156 (FIG. 3). In the example illustrated, the longitudinal cyclone axis 156 is aligned with the orientation of the vortex finder 144. The cyclone chamber 120 has a generally round cross-sectional shape and defines a cyclone chamber diameter 158.

In the illustrated example, a rear a portion of the dirt collection chamber sidewall 152 is integral with a rear portion of the cyclone chamber sidewall 124, and at least a portion of the second cyclone end wall 128 is integral with a portion of a first dirt collection chamber end wall 196.

Air Exit Duct

Air can exit the cyclone chamber 120 via an air outlet 142. As exemplified, the dirt collection chamber 122 is positioned below the lower end wall 128 of the cyclone chamber in which air outlet 142 (e.g., vortex finder 144) is provided. Accordingly, the cyclone air outlet includes a vortex finder 144 extending into the cyclone chamber 120 and a passage that extends through a portion of the dirt collection chamber 122, and preferably linearly through the dirt collection chamber, e.g. down duct 146. Optionally, a screen 148 can be positioned over the vortex finder 144. In some embodiments, the screen 148 and vortex finder 144 can be removable. The down duct 146 may comprise a generally cylindrical duct member extending through the interior of the dirt collection chamber 122.

In use, the down duct 146 and/or end wall 128 of the cyclone chamber 118 may vibrate. The vibrations may produce an undesirable noise. Further, the vibrations may interfere with the dirt separation efficiency of the cyclone bin assembly. Accordingly as exemplified, one or more stiffening ribs 150 may extend between the down duct 146 and the second end wall 128. Providing stiffening ribs 150 may help reduce the vibration of the down duct 146 and/or second end wall 128 when the surface cleaning apparatus 100 is in use. Alternatively, or in addition to connecting to the second end wall 128, stiffening ribs 150 may be configured to connect to the sidewall 152 and/or floor 154 of the dirt collection chamber 122.

Optionally, the down duct 146 may be detachable from the second end wall 128 of the cyclone chamber 120. If the down duct 146 is detachable from the second end wall 128, the stiffening ribs 150 may also be detachable from the down duct 146, or the second end wall 128 to help facilitate removal of the down duct 146.

The floor 154 of the dirt collection chamber 122 is openable. Opening the dirt collection chamber floor 154 may help facilitate emptying dirt and other debris from the dirt collection chamber 122. In the example illustrated, the dirt collection chamber floor 154 is pivotally connected to the dirt collection chamber sidewall 152 by hinge 198, and is pivotable between and open position (FIGS. 3-5) and a closed position (FIG. 2). The dirt collection floor 154 also comprises an air outlet aperture 200 that allows air from the down duct 146 to pass through the floor 154, and into the suction motor housing 114. Optionally, sealing gaskets 202, or other sealing members, can be provided around the perimeter of the floor 154 and around the air outlet aperture 200, to help seal the dirt collection chamber 122 when the floor 154 is closed.

Fine Particle Separator

Optionally, the cyclone bin assembly 118 can include a fine particle separator to help dis-entrain relatively fine dirt particles from the dirty air stream. In the example illustrated, the fine particle separator comprises an air recirculation chamber 160 surrounding the cyclone chamber 120 wherein air may rotate or swirl prior to re-entering the cyclone chamber 118. Preferably, as exemplified, the air recirculation chamber 160 comprises a generally annular flow chamber 162, part or all of which may be between the cyclone chamber sidewall 124 and an outer bin sidewall 164 (see for example FIG. 6). It will be appreciated that the annular flow chamber may be positioned above the cyclone chamber 118 and that some or all of the annular flow chamber 162 may face the dirt outlet 140.

The inner surface of the lid 130 may comprise an upper end wall 166 of the flow chamber 162. In this configuration, a user can access the flow chamber 162 as well as the cyclone chamber 118 when the lid is opened, for example, for cleaning or inspection. Alternatively, the flow chamber 162 can have an upper end wall that is separate from the lid 130. Air circulating within the air recirculation chamber flows in a rotational direction, generally about rotation axis 161.

Referring to FIG. 3, in the illustrated example, the flow chamber 162 surrounds the cyclone chamber 120. The height 170 of the flow chamber 162 can be selected so that it is approximately the same height 172 as the dirt outlet 140 of the cyclone chamber 120. Optionally, the flow chamber height 170 may be greater than or less than the dirt outlet height 172, and optionally can extend the entire height 174 of the cyclone chamber 120. While illustrated in combination with a vertically oriented cyclone chamber 120, the air recirculation chamber 160 can also be used with a cyclone chamber 120 oriented in another direction, including, for example, a horizontal cyclone chamber.

The fine particle separator is preferably also in communication with the dirt collection chamber 122. Accordingly, dirt collection chamber 122 may collect particulate matter separated by both the cyclone chamber and the fine particle separator. Preferably, the end of the fine particle separator closest to the dirt collection chamber 122 (e.g., the lower end) is continuous with the dirt collection chamber 122.

Figure 6:
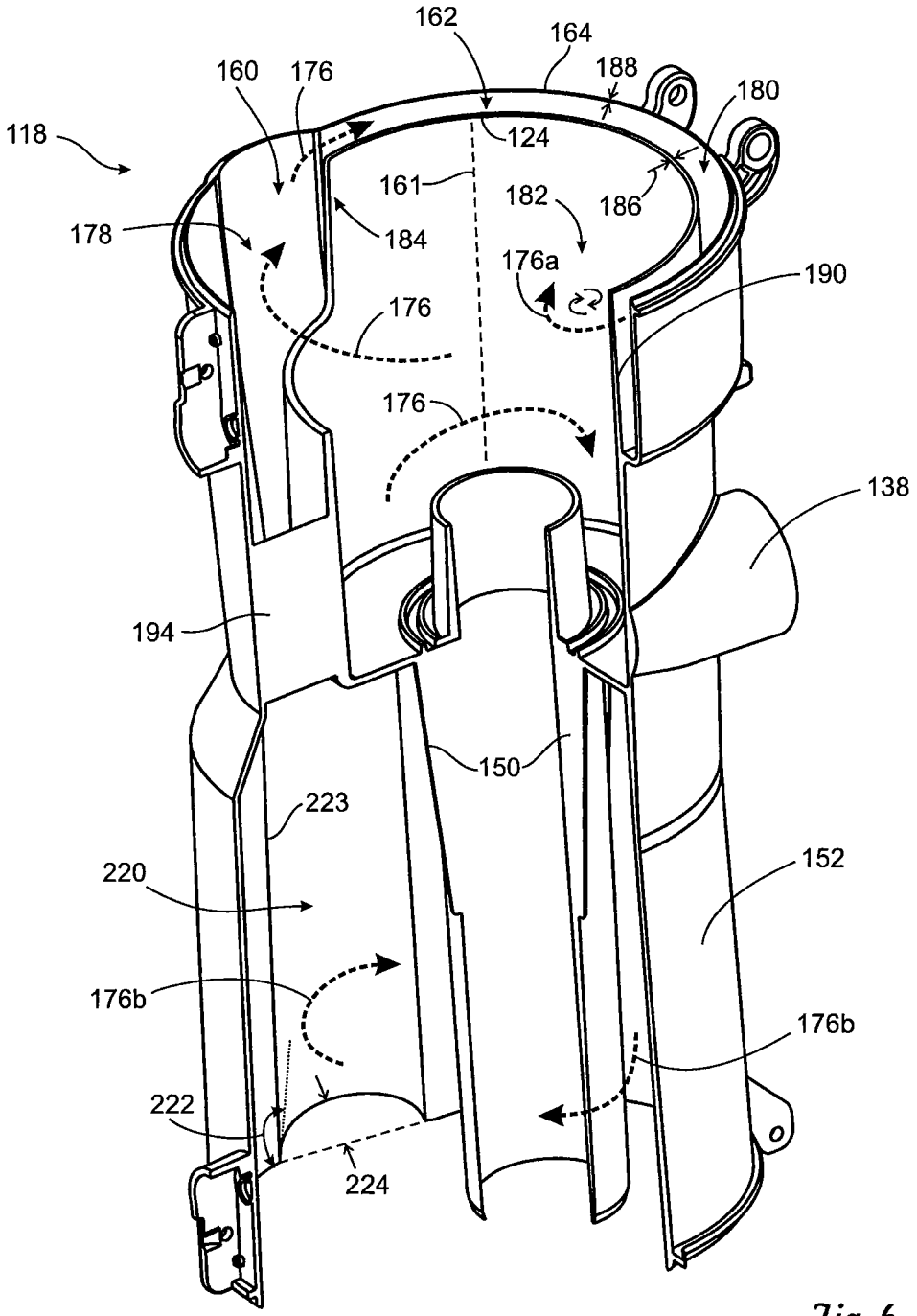
FIG. 6 is a partial cut away view of the cyclone bin assembly of FIG. 5, with the lid and floor removed.

Referring to FIG. 6, when the surface cleaning apparatus is use, a portion of the dirty air circulating within the cyclone chamber 120 can exit the cyclone chamber 118 via the dirt outlet 140 and travel into the flow chamber 162, as illustrated using arrows 176. The air entering the flow chamber 162 can carry entrained dirt particles. The air circulates in the annular flow chamber 162 before re-entering the cyclone chamber 118. Concurrently, particulate matter separated in the cyclone chamber 118 may be ejected through dirt outlet 140 and pass into the dirt collection chamber 122.

The cross sectional area of the annular flow chamber 162 in a plane transverse to the direction of rotation may be constant. Preferably, as exemplified, the cross-sectional area of the flow chamber varies, and preferably decreases, in the downstream direction. For example, the flow area of a first upstream portion 178 of the flow chamber 162 is greater than the flow area of a second downstream portion 180 of the flow chamber 162. In this configuration, when air flows from the first portion 178 into second portion 180, the velocity of the air can increase. Preferably, the area can be selected so that air traveling through the second portion 180 of the flow chamber 162 is traveling at a higher velocity than the air circulating within the cyclone chamber 120. Circulating the air at an increased velocity in the flow chamber 162 may help dis-entrain finer dirt particles then those that are dis-entrained in the cyclone chamber 118. Air exiting the second portion 180 of the flow chamber passes through a second portion outlet 182. Fine dirt particles dis-entrained in the air circulation chamber 160 can fall into the dirt collection chamber 122.

Referring to FIGS. 5 and 6, in the example illustrated, the flow area of the second portion 180 remains generally constant between the second portion inlet 184 and the second portion outlet 182. Alternatively, the second portion 180 can be configured so that the flow area of the second portion varies between the inlet and outlet 184, 182. For example, the second portion 180 can be configured so that the area at the outlet 182 is smaller than the area at the inlet 184. This configuration may further increase the velocity of the air traveling from the inlet to the outlet 184, 182. Alternatively, the second portion 180 can be configured so that the area at the inlet 184 is less than the area at the outlet 182.

To vary the cross-sectional area in the second portion 180, the thickness 186 of a portion of the cyclone chamber sidewall 124 can be varied, or the thickness 188 of the outer bin sidewall 164 can be varied, or both. Alternatively, instead of modifying the wall thicknesses 186, 188, a separate ramp insert can be positioned within the second portion 180 of the flow chamber. Alternately, or in addition, the height 170 of the annular flow region 162 may be varied.

Figure 7D:
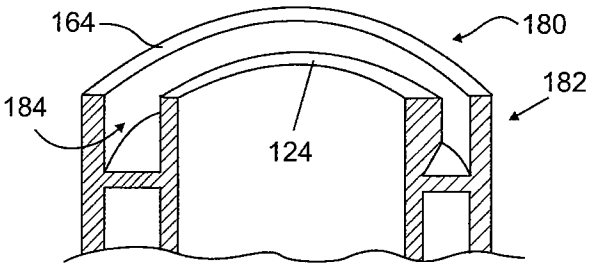
Figure 7C:
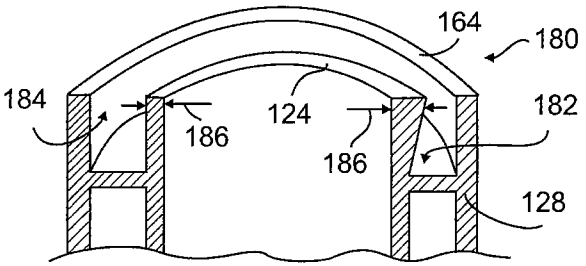
Figure 7E:
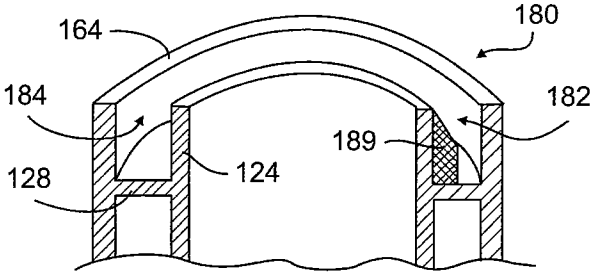
Figure 7B:
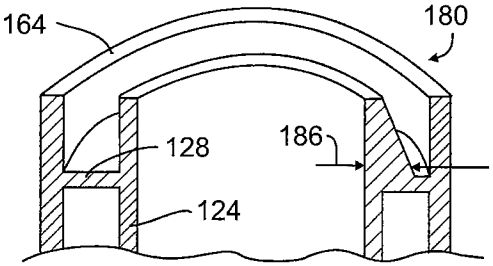
Figure 7A:
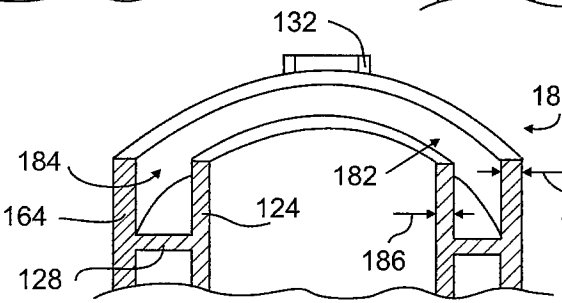

Referring to FIG. 7*a*, in a schematic representation of the second portion 180 of the flow chamber 162, the thickness 186 of the cyclone chamber sidewall 124 at the inlet 184 is equal to the thickness 186 of the cyclone chamber sidewall 124 at the outlet 182. Similarly, the thickness 188 of the sidewall 164 at the inlet 184 is equal to the thickness 188 of the sidewall 164 at the outlet 182. While not shown, the height may remain constant such that the cross sectional area remains constant.

In other embodiments, the wall thickness 186 at the outlet 182 may be different than the wall thickness 186 at the inlet 184, as illustrated using schematic representations in FIGS. 7*b*-7*e*. Similarly, the wall thickness 188 may be varied. FIGS. 7*e* and 10 illustrate embodiments in which a separate ramp member 189 is placed within the second portion 180 of the flow chamber 162, instead of varying the wall thickness 186 of the cyclone chamber sidewall 124.

Referring to FIGS. 5, 6 and 10, alternately, or in addition, a portion of the cyclone chamber sidewall 124 adjacent the second portion outlet 182 may be configured to disrupt the flow of air exiting the second portion outlet 182 and\or direct the air flow away for the dirt inlet 140. For example, the side wall or a ramp insert 189 may be provided at the outlet 182 to that the distance between the air flow region of portion 180 at outlet 182 and outlet 140 is increased. This will require the air to make a sharper turn to return to the cyclone chamber and may assist in separating finer dirt particles.

Alternately, or in addition, the cyclone chamber sidewall 124 may comprise a relatively sharp corner 190, which may help disrupt the air flow 176. Disrupting the air flowing past the corner 190 may help dis-entrain dirt particles from the air flow 176, and may help urge the air flow 176*a* to re-enter the cyclone chamber 12 via the dirt outlet 140.

Optionally, the dirt outlet slot 140 may be configured to have a varying slot height 172 along its length. Varying the height of the dirt outlet slot 140 may alter the behaviour of the air flowing through the slot 140, between the cyclone chamber 120 and the air recirculation chamber 160, for example air flows 176 and 176*a*.

Rib in the Dirt Collection Chamber

As exemplified in FIGS. 2-4, optionally, one or more ribs 194 may extend between the cyclone chamber sidewall 124 and the dirt collection chamber sidewall 152. The rib may be used with or without the fine particle separator. The rib may extend partway across the annular spaced between the sidewalls and preferably extends across the annular space between the sidewalls. Preferably, the rib 194 is positioned adjacent the dirt outlet 140 and more preferably, is positioned on the side of the dirt outlet 140 towards end wall 154 of the dirt collection chamber 122. Accordingly, the rib is provided in the upper annular portion of the dirt collection chamber 122 and may be below the fine particle separator if one is used.

The rib 194 may accordingly impede the flow of the air flow circulating within an upper portion of the dirt collection chamber 122, which may help separate dirt particles from the air stream and may reduce re-entrainment of separated particulate matter.

Variable Dirt Collection Sidewall

Referring to FIG. 3, optionally, the dirt collection chamber 122 can include a sidewall 152 having a variable cross-sectional area, and preferably the outer wall. In the illustrated example, the dirt collection chamber 122 comprises an upper portion 204 and a lower portion 206. The upper portion 204 is positioned adjacent the cyclone chamber 120 and comprises an upper portion sidewall 208 that at least partially surrounds the cyclone chamber 120. The upper portion 204 may also comprise some or all of the air recirculation chamber 160. The upper portion 204 of the dirt collection chamber 122 has a generally round cross-sectional shape, and has an upper dirt chamber diameter 210.

The lower portion 206 of the dirt collection chamber is positioned generally below the cyclone chamber 120. The lower portion 206 has a lower portion sidewall 212 with a generally round cross-sectional shape, and has a lower dirt chamber diameter 214. In the illustrated configuration, the lower dirt chamber diameter 214 is greater than the upper dirt chamber diameter 210. In this configuration, the dirt collection chamber 122 can be described as having a stepped out configuration. A transition surface 216 may connect the upper and lower portion sidewalls 208, 212. In the illustrated example, the transition surface 216 comprises an angled wall. In other examples, the transition surface can have another configuration, including, for example a horizontal or curved wall.

In use, a portion of the dirty air entering the cyclone chamber 120 may exit the cyclone chamber 120 via the dirt outlet, and can circulate within the dirt collection chamber 122. Air circulating within the dirt collection chamber 122 may eventually re-enter the cyclone chamber 120, via the dirt outlet 140, and exit the cyclone bin assembly 118 via the air outlet 142.

The cross sectional area or diameter of the dirt collection chamber may be varied using other sidewall configurations. For example, referring to FIGS. 8-11, another embodiment of a cyclone bin assembly 518 that can be used with a surface cleaning apparatus includes a cyclone chamber 520 and a dirt collection chamber 522. Features of the cyclone bin assembly 518 that are analogous to features of cyclone bin assembly 118 are represented by like reference characters, indexed by 400. Dirt collection chamber 522 includes an upper portion 604 and a lower portion 606. In this embodiment, the upper dirt collection diameter 610 is greater than the lower dirt collection diameter 614. In this configuration, the dirt collection chamber 522 can be described as having a stepped in configuration.

By way of further example, referring to FIG. 12*a*, a schematic representation of the stepped out cyclone bin assembly 118 illustrates a dirt collection chamber 122 with a lower portion diameter 214 that is greater than the upper portion diameter 210. FIG. 12*b*, is a schematic representation of the stepped in cyclone bin assembly 518, in which the upper portion diameter 610 is greater than the lower portion diameter 614. Other variable cross-section dirt collection chamber configurations can also be used. For example, FIG. 12*c* is a schematic representation of another embodiment of a cyclone bin assembly 718. The dirt collection chamber 722 in cyclone bin assembly 718 comprises an upper portion 804 having an upper portion diameter 810, a lower portion 806 having a lower portion diameter 812 and an intermediate portion 840 having an intermediate portion diameter 842. The upper and lower portion diameters 810, 814 are generally equal, and are both greater than the intermediate portion diameter 842. In this configuration the dirt collection chamber 822 comprises two transition surfaces 816. FIG. 12*d*, is a schematic representation of another embodiment of a cyclone bin assembly 918. The dirt collection chamber 922 in cyclone bin assembly 918 comprises an upper portion 1004 having an upper portion diameter 1010, a lower portion 1006 having a lower portion diameter 1014 and an intermediate portion 1040 having an intermediate portion diameter 1042. In this example, the upper and lower portion diameters 1010, 1014 are generally equal, and are both less than the intermediate portion diameter 1042. Like dirt collection chamber 718, dirt collection chamber comprises two transition surfaces 1016

Changes in the cross-sectional area may be used to enhance the separation efficiency of the cyclone chamber and associated dirt collection chamber. By varying the transverse cross sectional area of the dirt collection chamber, the flow dynamics of the air in the dirt collection chamber may be varied and the amount of dirt that is dis-entrained from the air may be decreased, or the amount of dirt that is re-entrained may be reduced. For example, if the cross sectional area of the portion of the dirt collection chamber distal to the dirt inlet (e.g., the lower portion 206) is less than the opposed portion (e.g. the upper portion with rib 194) adjacent the dirt inlet, then the air will slow down as it enters the upper portion. As the velocity decreases, the amount of dirt that may be re-entrained in the return airflow may decrease. If the cross sectional area of the portion of the dirt collection chamber distal to the dirt inlet (e.g., the lower portion) is greater than the opposed portion (e.g. upper portion) adjacent the dirt inlet, then the air will slow down as it enters the lower portion allowing more dirt to be dis-entrained.

Dirt Collection Chamber Wall Recesses

Referring to FIGS. 5 and 6, in the illustrated example, the dirt collection chamber sidewall 152 may comprise one or more recessed columns 220, on opposing sides of the dirt collection chamber 122. The recessed columns 220 can provide a discontinuity on the inner surface of the outer dirt collection chamber sidewall 152, which may create eddy currents or other disruptions in the dirty air flow circulating within the dirt collection chamber 122, represented by arrows 176*b*. Preferably, the angle 222 formed at the intersection between the dirt collection chamber sidewall 152 and the upstream or leading edge 223 of the recessed column 220 walls is sufficient to create a relatively sharp corner, which may help disrupt the air flow. Preferably, the angle 222 is between about 30 and about 90°, and more preferably is between 45 and 90°. Disrupting the circulation of the dirty air passing over the recessed columns 220 may help dis-entrain dirt particles. In other embodiments, the dirt collection chamber 122 can comprise a different number of recessed columns 220.

The depth 224 of the recessed columns 220 can be selected to provide a sufficient depth such that an area with reduced or no air flow is created such that dirt particles may settle out and travel to the dirt collection floor. Collecting dirt particles within the recessed columns 220 may also help prevent re-entrainment of the dirt particles in the circulating air flow. Preferably, the depth 224, represented using a dashed line to approximate the circumference of the uninterrupted sidewall 152, is between about 6 and about 18 millimeters, or optionally can be greater than 18 millimeters.

Connecting Wall

Referring to FIGS. 9 and 11, in addition to the stiffening ribs 550 the down duct 546 includes a vertically oriented connecting wall 630 extending between the down duct 546 and the dirt collection chamber sidewall 552. Preferably, the connecting wall 630 extends downward from the upper end wall 596, and has a height 632 that is between about 5% and about 80% of the height 634 of the lower portion 606 of the dirt collection chamber 522. More preferably, the connecting wall height 632 is between about 15% and 50% of the lower portion height 634. The connecting wall 630 can impede the circulation of the dirty air flowing within the lower portion 606. Impeding the circulation of the dirty air flow may help dis-entrain dirt particles from the dirty air flow. The dis-entrained particles can then be retained within the lower portion 606 when the circulating air re-enters the cyclone chamber 520. The connecting wall 630 may also provide additional stiffness and vibration damping to the down duct 546, as described above.

It will be appreciated that the following claims are not limited to any specific embodiment disclosed herein. Further, it will be appreciated that any one or more of the features disclosed herein may be used in any particular combination or sub-combination, including, without limitation, a dirt collection chamber with a variable diameter or cross sectional area, the fine particle separator, an annular dirt collection chamber with a rib or baffle, reinforcing ribs for a cyclone chamber floor and/or a down flow duct and a recess in the outer sidewall of the dirt collection chamber.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

(a) an air flow path extending from a dirty air inlet to a clean air outlet and including a suction motor;

(b) a cyclone chamber provided in the air flow path and comprising a cyclone chamber first end wall and a cyclone chamber second opposed end wall, a cyclone air inlet, a cyclone air outlet provided in the cyclone chamber second opposed wall end and a cyclone chamber sidewall, the cyclone chamber second opposed end wall having an inner surface positioned in the cyclone chamber and an outer surface positioned exterior to the cyclone chamber;

(c) an air exit conduit exterior to the cyclone chamber and extending from the cyclone air outlet; and, (d) at least one reinforcing rib positioned in abutting relationship with the air exit conduit and the outer surface of the cyclone chamber second opposed end wall.

2. The surface cleaning apparatus of claim 1 wherein the reinforcing rib is connected to the air exit conduit.

3. The surface cleaning apparatus of claim 1 wherein the reinforcing rib is connected to the cyclone chamber second opposed wall end.

4. The surface cleaning apparatus of claim 1 wherein the air exit conduit extends through a dirt collection chamber that is positioned exterior to the cyclone chamber.

5. The surface cleaning apparatus of claim 1 wherein the air exit conduit is removably mounted to the cyclone chamber.

6. The surface cleaning apparatus of claim 5 wherein the cyclone chamber comprises a vortex finder and the vortex finder remains in position when the air exit conduit is removed.

7. The surface cleaning apparatus of claim 1 wherein the cyclone air inlet is located adjacent the cyclone chamber second opposed end wall.

8. The surface cleaning apparatus of claim 7 wherein the cyclone chamber further comprises a cyclone dirt outlet located adjacent the cyclone chamber first end wall and the surface cleaning apparatus further comprises a dirt collection chamber in communication with the cyclone dirt outlet.

9. The surface cleaning apparatus of claim 1 wherein the cyclone chamber further comprises a cyclone dirt outlet located adjacent the cyclone chamber first end wall and the surface cleaning apparatus further comprises a dirt collection chamber in communication with the cyclone dirt outlet.

10. The surface cleaning apparatus of claim 9 wherein the dirt collection chamber extends at least part way around the cyclone chamber, the dirt collection chamber has a dirt collection chamber first end and a dirt collection chamber second opposed end that is spaced from and faces the cyclone chamber second opposed wall end and the air exit conduit extends between the cyclone chamber second opposed wall end and the dirt collection chamber second opposed end.

11. The surface cleaning apparatus of claim 1 further comprising a cyclone bin assembly that is removably mounted to the surface cleaning apparatus, the cyclone bin assembly comprising the cyclone chamber and a dirt collection chamber.

12. The surface cleaning apparatus of claim 11 wherein the air exit conduit extends through the dirt collection chamber.

13. The surface cleaning apparatus of claim 12 wherein the cyclone air outlet is provided in the cyclone chamber second opposed end wall and the dirt collection chamber has a dirt collection chamber end that is spaced from and faces the cyclone chamber second opposed end wall and the air exit conduit extends between the cyclone chamber second opposed end wall and the dirt collection chamber end.

14. The surface cleaning apparatus of claim 13 wherein the dirt collection chamber end is openable.

15. The surface cleaning apparatus of claim 14 wherein the dirt collection chamber end has an air exit port in communication with the air exit conduit and the air exit conduit remains in position when the dirt collection chamber end is opened.

16. The surface cleaning apparatus of claim 15 wherein the air exit conduit is removably mounted to the cyclone chamber.

17. The surface cleaning apparatus of claim 16 wherein the cyclone chamber comprises a vortex finder and the vortex finder remains in position when the air exit conduit is removed.

18. The surface cleaning apparatus of claim 13 wherein the cyclone air inlet is located adjacent the cyclone chamber second opposed end wall.

* * * * *

UNITED STATES PATENT AND TRADEMARK OFFICE

CERTIFICATE OF CORRECTION

PATENT NO. : 8,528,164 B2
APPLICATION NO. : 13/040768
DATED : September 10, 2013
INVENTOR(S) : Wayne Ernest Conrad It is certified that error appears in the above-identified patent and that said Letters Patent is hereby corrected as shown below:

In the Claims

Claim 1, Column 11, line 41 "...second opposed wall end..." should read -- ...second opposed end wall... --

Claim 3, Column 11, line 55 "...second opposed wall end..." should read -- ...second opposed end wall... --

Claim 10, Column 12, line 24 "...second opposed wall end..." should read -- ...second opposed end wall... --

Claim 10, Column 12, line 25 "...second opposed wall end..." should read -- ...second opposed end wall... --

Signed and Sealed this
Thirty-first Day of December, 2013

Margaret A. Focarino

Margaret A. Focarino
*Commissioner for Patents of the United States Patent and Trademark Office*